US006207276B1

(12) United States Patent
Spindler et al.

(10) Patent No.: US 6,207,276 B1
(45) Date of Patent: Mar. 27, 2001

(54) SHEATH-CORE BICOMPONENT FIBER AND ITS APPLICATIONS

(75) Inventors: Jürgen Spindler, Domat/Ems; Thomas Weller, Bonaduz; Simon Sutter, Rothenbrunnen; Gunther Schäch, Chur, all of (CH)

(73) Assignee: Ems-Chemie AG (CH)

( * ) Notice: Subject to any disclaimer, the term of this patent is extended or adjusted under 35 U.S.C. 154(b) by 0 days.

(21) Appl. No.: 09/448,770

(22) Filed: Nov. 24, 1999

(30) Foreign Application Priority Data

Nov. 26, 1998 (DE) ..... 198 54 732

(51) Int. Cl.[7] ..... D01F 8/00; D01F 8/12

(52) U.S. Cl. ..... 428/373; 428/374; 428/370; 428/221; 139/383 A

(58) Field of Search ..... 428/221, 373, 428/370, 374; 139/383 A

(56) References Cited

U.S. PATENT DOCUMENTS 4,323,622 * 4/1982 Gladh et al. ..... 428/230
5,617,903 * 4/1997 Bowen ..... 139/383 A
5,888,915 * 3/1999 Denton et al. ..... 139/383 A

FOREIGN PATENT DOCUMENTS 0 070 709 A2 1/1983 (EP) .
0 287 297 A1 10/1988 (EP) .
0 372 769 6/1990 (EP) .
0 473 430 A2 3/1992 (EP) .
0 529 506 B1 3/1993 (EP) .
0 741 204 A2 11/1996 (EP) .
WO 92/10607 6/1992 (WO) .
WO 97/27356 7/1997 (WO) .

* cited by examiner

*Primary Examiner*—Newton Edwards
(74) *Attorney, Agent, or Firm*—Finnegan, Henderson, Farabow, Garrett & Dunner, L.L.P.

(57) ABSTRACT

In a core-shroud bicomponent fiber, which exhibits a core and a shroud at least partially enveloping the core, an elevated abrasion behavior, a low compaction under exposure to temperature and pressure and a high strength of the fibers is achieved by having the shroud consist of 45–98% w/w of a first polyamide having a melting point exceeding 280° C., and 2–20% w/w of a layer silicate.

13 Claims, No Drawings

SHEATH-CORE BICOMPONENT FIBER AND ITS APPLICATIONS

TECHNICAL AREA

This invention relates to the area of synthetic fibers of the kind usually employed to manufacture paper machine felt, in particular of paper machine felt for use in the press area of paper machines. It relates to a sheath-core bicomponent fiber, significant parts of which consist of polyamide. It also relates to the use of such a fiber for manufacturing paper machine felt.

PRIOR ART

Press felts are used in paper machines to support the paper pulp and take water out of the paper pulp during the pressing procedure. This usually happens in the paper manufacturing process immediately after the headbox and Fourdrinier wire part, and before the sheet in the reeling end is completely dried.

To increase the dewatering performance in the pressing procedure, the temperatures in the press area of paper machines have in past years been continuously increased (B. Wahlstrom, "Pressing-the state of the art and future possibilities", Paper technology, February 1991, pp. 18–27). New developments such as "Hot Pressing" or "Impulse Pressing" (e.g., see D. Orloff et al., TAPPI Journal Vol. 81 (07/1998), pp. 113–116 and H. Larsson et al., TAPPI Journal Vol. 81 (07/1998), pp. 117–122) use in part very high temperatures. The high temperatures (at times over 200° C. in impulse pressing) lead to an advantageous reduction in water viscosity on the one hand, but place an enormous demand on the fibers processed in the press felts on the other. The high temperatures make in particular synthetic fibers soft in the jacket region, which can result in increased compaction and felt abrasion. Given an increase compaction, the fibers become conglutinated, the gaps in the felt get smaller, and hence the felt loses some of its capacity to take water out and away from the paper.

To ensure high felt run times, and hence the lowest possible machine downtimes, a high abrasion resistance and low compaction represents a very important criterion for the usability of fibers for press felts. For this reason, press felts today consist almost exclusively of polyamide 6 (PA 6) or PA 66) fibers and monofilaments, although the literature also describes felts made out of PA 11 fibers (EP 0 372 769), and PA 12 fibers (EP 0 287 297), etc.

PEEK (polyetheretherketone) fibers (EP 0 473 430) or PTFE (polytetrafluoroethylene) fibers (WO 9210607) have also been tested for use in paper machine felts, for example. While they proved suitable in terms of temperature resistance, their low abrasion resistance does not enable any acceptable felt run times.

The use of fibers as partially aromatic polyamides, along with a buildup of fibers as bicomponent fibers consisting of two components arranged side to side has been proposed (EP 529 506), but sufficient abrasion resistances have also yet to be achieved with such fibers.

Compaction was to be prevented by coating fibers with layer silicates, e.g., by manufacturing layer silicate-containing fibers and monofilaments (WO 97/27356; EP 0 070 709). The disadvantage to Incorporating layer silicates into the fiber polymer is that fiber strength is greatly diminished, however.

EP 0 741 204 describes the use of sheath-core bicomponent adhesive fibers for press felts that are primarily designed to improve the surface quality, run characteristics of the felt, recovery and dewatering. This is accomplished with bonds that are generated by melting on the sheath component.

DESCRIPTION OF THE INVENTION

The object of the invention is therefore to provide a fiber that, for example when processed into a paper machine felt, exhibits a sufficient abrasion resistance and simultaneously withstands high temperatures, in particular under the conditions that arise during impulse pressing, without becoming significantly compacted and conglutinated.

This task is achieved in a fiber of the kind mentioned at the outset by designing the fiber as a sheath-core bicomponent fiber that exhibits a core and a sheath that at least partially envelops the core, and by having the sheath consist of 45–98% w/w of a first polyamide having a melting point exceeding 280° C., and 2–20% w/w of a layer silicate. In addition, the core consists of a second polyamide. The sheath also contains up to 35% w/w of this second polyamide. The core of the invention is therefore to build up the fibers as a sheath-core bicomponent fiber, and to use a layer silicate-containing and high-melting point sheath both to prevent compacting and achieve a high abrasion resistance, but to prevent the reduction in fiber strength caused by the incorporation of silicates by having a solid core be present. The fact that the core consists of a second polyamide and the sheath also contains up to 35% w/w of this second polyamide ensures an intimate bond between the core material and sheath material.

The feature of one preferred embodiment is that at least the core or the sheath or both parts contain up to 1% w/w of heat stabilizers, and that in particular these heat stabilizers are inhibited phenols, phosphonic acid derivatives, phosphates or combinations of these stabilizers. This is another effective measure for increasing heat stability, and hence for preventing the two-component fiber from compacting.

In addition, the invention claims the use of such a fiber according to the invention for manufacturing a paper machine felt, in particular a needled paper machine felt, which continuous to be preferably geared toward use in the pressing area, in particular in impulse pressing or hot pressing.

Additional embodiments of the sheath-core bicomponent fiber and the application of the latter arise from the dependent claims.

PERFORMANCE OF THE INVENTION

In describing the manufacture of a fiber according to the invention out of two components designed as the core and sheath, the composition of the core followed by that of the sheath will first be discussed.

The core is preferably manufactured out of PA 6 or PA 66 with a relative solution viscosity of 2.4–5.0 (1 g polymer per 100 ml of 96% sulfuric acid at 25° C.) or mixtures of the corresponding PA 6 and PA 66 qualities in a 1:99 to 99:1 ratio. Polyamide types PA 11, PA 12, PA 69, PA 610, PA 612 or PA 1212 with a relative solution viscosity of 1.6–2.8 can also be used for the core (0.5 g of polymer per 100 ml of m-cresol at 25° C.). In addition, the core should preferably contain 0–1% 2/2 of heat stabilizers, e.g., based on sterically inhibited phenols, phosphonic acid derivatives or phosphites or combinations of these stabilizers. The core hence ensures the necessary strength of the fibers, for example when they are processed to felts.

The sheath must consist of a polyamide with a melting point of at least 280° C., and it must contain an additional 2–20% w/w of layer silicates (e.g., MICROMICA® MK 100 from the company CO-OP Chemical CO., LTD, Japan) and 0–35% w/w of the polyamide type used to build up the core. Suitable polyamides with a melting point of at least 280° C. include

- PA 46 hompolymers based on tetramethylenediamine and adipic acid;
- PA 46/4T copolymers based on tetramethylenediamine, adipic acid, and terephthalic
- PA 66/6T copolymers based on hexamethylenediamine, adipic acid, and terephthalic acid;
- PA 6T/6I copolymers based on hexamethylenediamine, terephthalic acid, and isophthalic acid;
- PA 9T homopolymers based on nonanediamine and terephthalic acid;
- PA 10T homopolymers based on decanediamine and terephthalic acid;
- PA 12T homopolymers based on dodecanediamine and terephthalic acid; and
- PA MPMD T/6I copolymers based on 2-methyl-1,5-pentanediamine, hexamethylenediamine, terephthalic acid and isophthalic acid.

The above listed polyamides can contain up to 20% w/w of additional monomers such as caprolactam or laurinlactam. The sheath also contains 0–1% w/w heat stabilizers, e.g.; based on sterically inhibited phenols, phosphonic acid derivatives or phosphates or combinations of these stabilizers. The layer silicates can either be incorporated into the polymer through compounding with a two-screw extruder or, during the polymerization of one of the PA components, be added at the beginning of polymerization already, which enables a better distribution. To improve adhesion between the polyamide and layer silicate particles, coupling agents such as amino-silanes can also be used, of course.

The core can be concentrically or non-concentrically enveloped by the sheath. Given a non-concentric sheath-core distribution, suitable spinning and stretching conditions can generate a helical rippling.

The mass ratio between the core and sheath should advisedly lie between 30:70 and 70:30, but other component ratios are also possible.

The titer range, i.e., the fineness degree of bicomponent fibers expressed as a length-related measure, extends from 6.7 to 100 dtex (1 dtex=0.1 tex=0.1 g/km), but fibers outside this range can basically be manufactured as well.

As opposed to the core-sheath bicomponent adhesive fiber described above (EP 0 741 204), the core-sheath bicomponent fiber according to the invention prevents the fiber fleece from becoming conglutinated or compacted at high temperatures. This is very important, since the core-sheath bicomponent fibers according to the invention are not only used in small amounts in the felt, but constitute at least the main fiber component in the cover layer.

It is proposed that several comparative examples and embodiments be adduced in detail as follows:

EXAMPLE 1

(Comparative Example)

A fleece with a GSM of 200 g/m$^2$ was manufactured out of 17 dtex of PA 6 fibers (type TM 4000) from EMS Chemie AG. Three layers of this fleece were needled on the paper side, and two layers on the machine side of a PA 6 monofilament fabric. This test felt was subsequently fixed for 10 minutes at 165° C.

EXAMPLE 2

(Comparative Example)

17 dtex fibers were manufactured as follows: 89.5% w/w PA 6 with a relative viscosity of 3.4 (1 g of polymer per 100 ml of 96% sulfuric acid at 25° C.), 10% w/w of layer silicate, type MICROMICA® MK 100, 0.5% w/w of Irganox® 1098 stabilizer (Clariant, formerly Ciba-Geigy) were compounded with a two-shaft extruder at 280° C., after all components had been pre-dried. The compounded material was dried, and then spun into fibers, stretched, curled and cut on a spinning machine. It should be noted that Irganox® 1098 stabilizer is N,N'-hexamethylene bis (3,5-di-tert-butyl-4-hydroxy-hydrocinnamamide). Machine settings: Melting temperature at extruder head: 300° C.; temperature of spinning beam and nozzle packet: 300° C.

| | |
|---|---|
| Spinning nozzle: | 279 hole |
| Hole diameter: | 0.6 mm |
| Throughput: | 1066 g/min |
| Spinning speed: | 1000 m/min |
| Preparation laying-on device: (Phosphoric acid ester) | 0.3% |
| Drawing ratio | 2.4 |
| Temperature, stretching godets | 170° C. |
| Air-jet texturing | |
| Dryer temperature | 170° C. |
| Cut length | 80 mm |

A fleece with a GSM of 200 g/m$^2$ was made out of the resulting fibers. Three layers of this fleece were needled on the paper side, and two layers on the machine side of a PA 6 monofilament fabric. This test felt was subsequently fixed for 10 minutes at 165° C.

EXAMPLE 3

(Comparative Example)

b 17dtex fibers were manufactured as follows: 89.5% w/w of PA 6/T66, type Arlen® C2300 (PA 66/6T, from MITSUI, melting point 290–295° C.), 10% w/w of layer silicate, type MICROMICA® MK 100 and 0.5% w/w of Irganox® 1098 heat stabilizer were compounded with a two-shaft extruder at 315° C., after all components had been pre-dried. The compounded material was dried, and then spun into fibers with the mentioned spinning machine.

Machine settings: Melting temperature at extruder head: 315° C.; temperature of spinning beam and nozzle packet: 315° C.

| | |
|---|---|
| Spinning nozzle: | 279 hole |
| Hole diameter: | 0.6 mm |
| Throughput: | 1066 g/min |
| Spinning speed: | 1000 m/min |
| Preparation laying-on device: (Phosphoric acid ester) | 0.3% |
| Drawing ratio | 2.4 |
| Temperature, stretching godets | 190° C. |
| Air-jet texturing | |
| Dryer temperature | 190° C. |
| Cut length | 80 mm |

A fleece with a GSM of 200 g/m$^2$ was made out of the resulting fibers. Three layers of this fleece were needled on the paper side, and two layers on the machine side of a PA 6 monofilament fabric. This test felt was subsequently fixed for 10 minutes at 165° C.

EXAMPLE 4

(Comparative Example)

17 dtex core-sheath bicomponent fibers with a core-sheath ratio of 50/50 were manufactured as follows:

Core component: PA 6 with a relative viscosity of 4.0 (1 g of polymer per 100 ml of 96% sulfuric acid at 25° C.) and 0.5% w/w Irganox® 1098 heat stabilizer.

Shroud component: 99.5% w/w of PA 6T/66 (Arlen® C 2300), 0.5% w/w Irganox® 1098 heat stabilizer, wherein the heat stabilizer was metered in as a 5% master batch in PA 6T/66 (Arlen® C 2300). Both components were dried and spun into core-shroud fibers on the mentioned machine with a bicomponent spinning nozzle.

Machine settings: Melting temperature of the core component at the extruder head: 315° C.; melting temperature of shroud component at extruder head: 315° C.; temperature of spinning beam and nozzle packet: 315° C.

| | |
|---|---|
| Spinning nozzle: | 210 hole |
| Hole diameter: | 0.7 mm |
| Throughput per component: | 401 g/min |
| Spinning speed: | 1000 m/min |
| Preparation laying-on device: (Phosphoric acid ester) | 0.3% |
| Drawing ratio | 2.4 |
| Temperature, stretching godets | 180° C. |
| Air-jet texturing | |
| Dryer temperature | 190° C. |
| Cut length | 80 mm |

A fleece with a GSM of 200 g/m$^2$ was made out of the resulting fibers. Three layers of this fleece were needled on the paper side, and two layers on the machine side of a PA 6 monofilament fabric. This test felt was subsequently fixed for 10 minutes at 165° C.

EXAMPLE 5

17 dtex core-sheath bicomponent fibers with a core-sheath ratio of 50/50 were manufactured as follows:

Core component: PA 6 with a relative viscosity of 4.0 (1 g of polymer per 100 ml of 96% sulfuric acid at 25° C.) and 0.5% w/w Irganox® 1098 heat stabilizer.

Sheath component: 25% w/w of PA 6 with a relative viscosity of 2.8 (1 g of polymer per 100 ml of 96% sulfuric acid at 25° C.), 10% w/w of layer silicate, type MICROMICA® MK 100, 64.5% w/w of PA 6T/66 (Arlen® C 2300) and 0.5% w/w of Irganox® 1098 heat stabilizer were compounded with a two-shaft extruder at 315° C., after all components had been pre-dried. Both components were dried, and then spun into core-sheath fibers with the bicomponent spinning machine.

Machine settings: Melting temperature of the core component at the extruder head: 315° C.; melting temperature of sheath component at extruder head: 315° C.; temperature of spinning beam and nozzle packet: 315° C.

| | |
|---|---|
| Spinning nozzle: | 210 hole |
| Hole diameter: | 0.7 mm |
| Throughput per component: | 401 g/min |
| Spinning speed: | 1000 m/min |
| Preparation laying-on device: (Phosphoric acid ester) | 0.3% |
| Drawing ratio | 2.4 |
| Temperature, stretching godets | 180° C. |
| Air-jet texturing | |
| Dryer temperature | 190° C. |
| Cut length | 80 mm |

A fleece with a GSM of 200 g/m$^2$ was made out of the resulting fibers. Three layers of this fleece were needled on the paper side, and two layers on the machine side of a PA 6 monofilament fabric. This test felt was subsequently fixed for 10 minutes at 165° C.

EXAMPLE 6

17 dtex core-sheath bicomponent fibers with a core-sheath ratio of 50/50 were manufactured as follows:

Core component: PA 66 with a relative viscosity of 3.4 (1 g of polymer per 100 ml of 96% sulfuric acid at 25° C.) and 0.5% w/w Irganox® 1098 heat stabilizer.

Sheath component: 25% w/w of PA 66 with a relative viscosity of 2.8 (1 g of polymer per 100 ml of 96% sulfuric acid at 25° C.), 10% w/w of layer silicate, type MICROMICA® MK 100, 64.5% w/w of PA 6T/66 (Arlen® C 2300) and 0.5% w/w of Irganox® 1098 heat stabilizer were compounded with a two-shaft extruder at 315° C., after all components had been pre-dried. Both components were dried, and then spun into core-sheath fibers with the bicomponent spinning machine at the same settings as in Example 4.

A fleece with a GSM of 200 g/m$^2$ was made out of the resulting fibers. Three layers of this fleece were needled on the paper side, and two layers on the machine side of a PA 6 monofilament fabric. This test felt was subsequently fixed for 10 minutes at 165° C.

EXAMPLE 7

17 dtex core-sheath bicomponent fibers with a core-sheath ratio of 50/50 were manufactured as follows:

Core component: PA 6 with a relative viscosity of 4.0 (1 g of polymer per 100 ml of 96% sulfuric acid at 25° C.) and 0.5% w/w Irganox® 1098 heat stabilizer.

Sheath component: 10% w/w of layer silicate, type MICROMICA® MK 100, 89.5% w/w of PA 6T/66 (Arlen® C 2300) and 0.5% w/w of Irganox® 1098 heat stabilizer were compounded with a two-shaft extruder at 315° C., after all components had been pre-dried. Both components were dried, and then spun into core-shroud fibers with the bicomponent spinning machine at the same settings as in Example 4.

A fleece with a GSM of 200 g/m$^2$ was made out of the resulting fibers. Three layers of this fleece were needled on the paper side, and two layers on the machine side of a PA 6 monofilament fabric. This test felt was subsequently fixed for 10 minutes at 165° C.

The above representative fibers processed to felts were subjected to the following tests, the results of which are summarized in Table 1.

1. Abrasion Test:

A portion of the felt was treated on a felt test press (FTP) (according to DE 44 34 898 C2, page 5, lines 27 to 56 and figures). The water temperature was set to 50° C.

The fiber loss is indicated to assess abrasion. The lower the fiber loss, the better the abrasion resistance.

2. Temperature Resistance (resistance to compaction at higher temperatures):

Another portion of the felt was first stored 24 hours in demineralized water at room temperature and subsequently treated as follows:

In a tensioning apparatus, the moist felt is treated with a calendar (lower roller T=205° C., upper roller cold, line pressure 70 kN-m=. The felt runs through the calendar every at a felt length of 2 m and a speed of 30 m/min. At an assumed nip width of 20 mm, the retention time in the nip measures approx. 40 milliseconds. Therefore, the test duration runs 3600 cycles at 4 hours.

The felt quality is assessed based on the percentage permeability (L) of the felt ($L_1$) after this treatment relative to the air permeability of the felt ($L_0$) prior to treatment. The higher this value, the better suited the felt and the corresponding fibers. At a calendar temperature of 50° C., this value lies at L=71% for comparative example 1.

TABLE 1

| Variant | 1 | 2 | 3 | 4 | 5 | 6 | 7 |
|---|---|---|---|---|---|---|---|
| Fiber loss [g/m$^2$] | 16 | 93 | 163 | 43 | 30 | 38 | 45 |
| Air permeability L [%] | 3 | 35 | 65 | 45 | 63 | 67 | 65 |

While comparative variant 1 is unusable at high temperatures due to total compaction, a very poor abrasion resistance results for comparative variant 3. Even though compaction is significantly reduced for comparative variant 2, the level is not acceptable, and abrasion resistance tapers off considerably. Even with comparative variant 4, the compaction is still too high.

In examples 5 to 7 of the invention, the abrasion resistance also tapers off, but the results still lie within a range that is state of the art and acceptable in the paper industry.

The compaction at high temperatures is clearly lower than for comparative variants 1 and 2.

What is claimed is:

1. A core-sheath bicomponent fiber, comprising:

a sheath comprising at least one first polyamide, at least one second polyamide, and at least one layer silicate; and a core comprising said at least one second polyamide, wherein said sheath at least partially envelops said core, said first polyamide has a melting point greater than 280° C. and is present in said sheath in an amount ranging from about 45 to about 98% by weight relative to the total weight of the sheath, and wherein said layer silicate is present in said sheath in an amount ranging from 2 to 20% by weight relative to the total weight of said sheath.

2. The core-sheath bicomponent fiber according to claim 1, wherein said at least one second polyamide is chosen from PA 6, PA66, and mixtures thereof, said mixture having a PA 6:PA 66 ratio ranging from 1:99 to 99:1, said at least one second polyamide has a relative solution viscosity of 2.4–5.0 measured in sulfuric acid, wherein 1 g of polymer per 100 ml of 96% sulfuric acid is inspected at 25° C., and wherein the relative solution viscosity of said at least one second polyamide of said sheath can differ from the relative solution viscosity of said at least one second polyamide of said core.

3. The core-sheath bicomponent fiber according to claim 1, wherein said at least one second polyamide is chosen from PA 11, PA 12, PA 69, PA 610, PA 1212, and mixtures thereof, and wherein said at least one second polyamide has a relative solution viscosity of 1.6–2.8, measured in m-cresol, wherein 0.5 g of polymer per 100 ml of m-cresol is inspected at 25° C.

4. The core-sheath bicomponent fiber according to claim 1 wherein said sheath comprises a first said at least one first polyamide is chosen from PA 46, PA 46/4T, PA 66/6T, PA 6T/6I, PA 9T, PA 10T, PA 12T, PA MPMD T/6I, and mixtures thereof, and up to 20% w/w of a second at least one first polyamide chosen from additional comonomers.

5. The core-sheath bicomponent fiber according to claim 1, wherein the core or sheath or both components contain up to 1% w/w of heat stabilizers.

6. The core-sheath bicomponent fiber according to claim 5, wherein the heat stabilizers are chosen from sterically hindered phenols, phosphonic acid derivatives, phosphates, and combinations thereof.

7. The core-sheath bicomponent fiber according to claim 1, wherein the fiber exhibits a length-related mass within a range of 5 to 200 dtex.

8. The core-sheath bicomponent fiber according to claim 1, wherein the mass ratio of core to sheath ranges from 7:3 to 3:7.

9. The core-sheath bicomponent fiber according to claim 4, wherein the additional comonomers are caprolactam or laurinlactam.

10. The core-sheath bicomponent fiber according to claim 1, wherein the fiber exhibits a length-related mass within a range of 6.7 to 100 dtex.

11. The paper machine felt according to claim 1, wherein said paper machine felt is a needled paper machine felt.

12. A paper machine felt comprising the core-sheath bicomponent fiber of claim 1.

13. A paper machine felt comprising the core-sheath bicomponent fiber of claim 1, wherein said paper machine felt is designed for use in the press area.

* * * * *